US007267106B2

(12) United States Patent
Adachi et al.

(10) Patent No.: US 7,267,106 B2
(45) Date of Patent: Sep. 11, 2007

(54) FUEL PRESSURE DETECTOR FOR COMMON RAIL TYPE FUEL INJECTION APPARATUS, AND COMMON RAIL TYPE FUEL INJECTION APPARATUS EQUIPPED WITH THE FUEL PRESSURE DETECTOR

(75) Inventors: Hitoshi Adachi, Osaka (JP); Hideo Shiomi, Osaka (JP); Takashi Miyamoto, Osaka (JP)

(73) Assignee: Yanmar Co., Ltd., Osaka (JP)

( * ) Notice: Subject to any disclaimer, the term of this patent is extended or adjusted under 35 U.S.C. 154(b) by 181 days.

(21) Appl. No.: 10/506,793

(22) PCT Filed: Sep. 25, 2003

(86) PCT No.: PCT/JP03/12292

§ 371 (c)(1),
(2), (4) Date: Sep. 7, 2004

(87) PCT Pub. No.: WO2004/031561

PCT Pub. Date: Apr. 15, 2004

(65) Prior Publication Data

US 2005/0103311 A1 May 19, 2005

(30) Foreign Application Priority Data

Sep. 30, 2002 (JP) ..... 2002-285873

(51) Int. Cl.
*F02M 7/00* (2006.01)
*F02M 52/00* (2006.01)

(52) U.S. Cl. ..... 123/436; 123/494

(58) Field of Classification Search ..... 123/456, 123/494, 446, 500, 501, 436, 419; 73/119 A, 73/117.3
See application file for complete search history.

(56) References Cited

U.S. PATENT DOCUMENTS

| | | | | |
|---|---|---|---|---|
| 5,313,924 | A | 5/1994 | Regueiro | |
| 5,564,391 | A * | 10/1996 | Barnes et al. | 123/446 |
| 5,678,521 | A * | 10/1997 | Thompson et al. | 123/447 |
| 6,085,727 | A * | 7/2000 | Nakano | 123/447 |
| 6,105,554 | A * | 8/2000 | Nishiyama | 123/436 |
| 6,516,782 | B1 * | 2/2003 | Thomas | 123/436 |

(Continued)

FOREIGN PATENT DOCUMENTS

EP 0 905 359 A2 3/1999

(Continued)

OTHER PUBLICATIONS

International Search Report for PCT/JP03/12292 mailed on Dec. 16, 2003.

(Continued)

*Primary Examiner*—Carl S. Miller
(74) *Attorney, Agent, or Firm*—Rader, Fishman & Grauer PLLC

(57) ABSTRACT

In collecting fuel pressure data in a common rail 2 during engine operation, the common rail fuel pressure is detected each time a crank shaft rotates 6°, and the common rail fuel pressure is stored in storage means 12 by associating the common rail fuel pressure with a cylinder number and a crank angle for tabulation, thus providing improved detection data accuracy.

5 Claims, 14 Drawing Sheets

U.S. PATENT DOCUMENTS

| | | | | |
|---|---|---|---|---|
| 6,694,953 | B2 * | 2/2004 | Barnes et al. | 123/500 |
| 6,725,837 | B2 * | 4/2004 | Hiraku et al. | 123/436 |
| 2001/0032619 | A1 | 10/2001 | Nishiyama | |

FOREIGN PATENT DOCUMENTS

| | | | |
|---|---|---|---|
| EP | 0 969 196 | A2 | 1/2000 |
| EP | 1 036 923 | A2 | 9/2000 |
| EP | 1 039 117 | A2 | 9/2000 |
| EP | 1 236 880 | A1 | 9/2002 |
| JP | 2000-18078 | | 1/2000 |
| JP | 2000-265896 | | 9/2000 |
| JP | 200-282932 | A1 | 10/2000 |

OTHER PUBLICATIONS

Supplementary European Search Report for the Application No. EP 03 79 9137, dated Oct. 13, 2005.

Japanese Office Action dated Jan. 9, 2007 for corresponding application No. 2002-285873.

* cited by examiner

FIG.11

| POS / CYL | 1 | 2 | --- | n-1 | n |
|---|---|---|---|---|---|
| 1 | --- | --- | --- | --- | --- |
| 2 | --- | --- | --- | --- | --- |
| ⋮ | --- | --- | --- | --- | --- |
| k-1 | --- | --- | --- | --- | --- |
| k | --- | --- | --- | --- | --- |

| Sample No. | 1 | 2 | ---- | n-1 | n |
|---|---|---|---|---|---|
| Value | ---- | ---- | ---- | ---- | ---- |

FUEL PRESSURE DETECTOR FOR COMMON RAIL TYPE FUEL INJECTION APPARATUS, AND COMMON RAIL TYPE FUEL INJECTION APPARATUS EQUIPPED WITH THE FUEL PRESSURE DETECTOR

TECHNICAL FIELD

The present invention relates to a fuel pressure detector for detecting common rail fuel pressure provided in a common rail type fuel injection apparatus equipped with a pressure accumulation pipe (so-called common rail) used for a fuel supply system of a diesel engine, etc. The invention relates also to a common rail type fuel injection apparatus equipped with the fuel pressure detector. More particularly, the invention relates to measures for providing improved accuracy in common rail fuel pressure detection data.

BACKGROUND ART

The common rail type fuel injection apparatus, superior in controllability to the mechanical fuel injection pump-nozzle system, has been previously proposed as a fuel supply system for multi-cylinder diesel engines and the like (e.g., see Japanese Patent Application Laid-Open Publication No. 2000-18052).

This type of fuel injection apparatus stores fuel, pressurized to a given pressure by a high-pressure pump, in a common rail and injects fuel stored in the common rail from a given injector in synchronization with fuel injection timings. A controller is provided to control the common rail fuel pressure and the operations of the individual injectors such that fuel is injected in optimal fuel injection conditions for the engine operation status.

Thus, the common rail type fuel injection apparatus has hitherto been developed as a fuel injection apparatus with excellent controllability because the apparatus is capable of controlling, in addition to the fuel injection amount and time, the fuel injection pressure—the pressure determined by the common rail fuel pressure—according to the engine operation status.

A description will be given below of a fuel injection system equipped with an ordinary common rail type fuel injection apparatus.

FIG. 17 is a schematic view of the overall configuration of a fuel supply system in a multi-cylinder diesel engine equipped with a common rail type fuel injection apparatus. The present common rail type fuel injection apparatus comprises a plurality of fuel injection valves (hereinafter referred to as "injectors") b, b, . . . attached correspondingly to individual cylinders of the diesel engine (hereinafter simply referred to as "engine") a, a common rail c for accumulating high-pressure fuel under a relatively high pressure (common rail pressure: 20 MPa, etc.), a high-pressure pump f for pressurizing fuel, sucked from a fuel tank d via a low-pressure pump e, to a high pressure and injecting the fuel into the common rail c and a controller (ECU) g for electronically controlling the injectors b, b, . . . and the high-pressure pump f.

Each of the injectors b, b, . . . is attached to the downstream end of each of fuel pipes that individually communicate with the common rail c. Fuel injection from the injectors b is controlled, for example, by energizing and de-energizing (ON/OFF) injection control solenoid valves h provided midway along the fuel pipes. That is, the injectors b inject high-pressure fuel supplied from the common rail c to the combustion chamber of the engine a during the time period when the injection control solenoid valves h are open. For this reason, a given high common rail pressure (20 MPa), equivalent to the fuel injection pressure, must be accumulated in the common rail, as a result of which the high-pressure pump f is connected via a fuel supply pipe i and a discharge valve j.

On the other hand, the ECUg receives engine information inputs such as engine rpm and load and outputs a control signal to the injection control solenoid valves h so as to obtain the fuel injection time and amount judged optimal based on these signals. At the same time, the ECUg outputs a control signal to the high-pressure pump f so as to provide the optimal fuel injection pressure in accordance with the engine rpm and load. Further, the common rail c is provided with a pressure sensor k for detecting the common rail inner pressure, and the fuel injection amount discharged from the high-pressure pump f to the common rail c is controlled such that the signal from the pressure sensor k becomes the preset optimal value in accordance with the engine rpm and load.

As disclosures of methods of detecting the common rail fuel pressure, a fuel injection apparatus disclosed in Japanese Patent Application Publication No. 7-122422 and a common rail pressure detector disclosed in Japanese Patent Publication No. 3235201 are proposed.

Japanese Patent Application Publication No. 7-122422 discloses constant monitoring of the common rail fuel pressure, whereas Japanese Patent Publication No. 3235201 discloses computation of the common rail fuel pressure without directly detecting the pressure.

Incidentally, to obtain the optimal fuel injection conditions (fuel injection time and amount) appropriate for the engine rpm, load and so forth in such a common rail type fuel injection apparatus, it is necessary to recognize with high accuracy the common rail fuel pressure—the pressure governing the fuel injection pressure—and exercise control such that the optimal pressure is constantly maintained as the common rail fuel pressure. That is, it is essential to recognize the common rail fuel pressure with high accuracy, thus allowing proper drive control of the high-pressure pump and fuel injection control associated therewith.

As for the common rail type fuel injection apparatus previously proposed, however, proper proposals have yet to be made at present as to collection of fuel pressure data in the common rail and further as to improvement of the data accuracy.

In light of the above, it is an object of the present invention to improve the accuracy of fuel pressure detection data in the common rail in a common rail type fuel injection apparatus and thereby improve the reliability of basic data used for engine control and other purposes.

DISCLOSURE OF THE INVENTION

To achieve the aforementioned object, the present invention prescribes sampling timings for the fuel pressure data by detecting the common rail fuel pressure at every given crank angle (every time the crank shaft rotates a given angle) or every time a given time elapses for collection of fuel pressure data in the common rail during engine operation, thus providing improved accuracy in detection data and improved use value of the detection data.

More specifically, first of all, the following configuration is among solution means designed to detect the common rail fuel pressure every given crank angle. That is, the invention is based on a fuel pressure detector for a common rail type fuel injection apparatus, the fuel pressure detector disposed in the common rail type fuel injection apparatus for detecting a common rail fuel pressure, the common rail type fuel injection apparatus being equipped with a fuel pump for pressure-feeding fuel, a common rail for storing fuel pressure-fed from the fuel pump, and fuel injection valves for injecting fuel supplied from the common rail.

The fuel pressure detector comprises cylinder number judgment means for judging a cylinder number of the engine; crank angle detection means for detecting a crank angle; and pressure detection means for detecting the common rail fuel pressure every given crank angle in response to an output signal from the crank angle detection means. The fuel pressure detector further comprises storage means for storing the cylinder number, the crank angle and the common rail fuel pressure by associating them with one another in response to outputs from the cylinder number judgment means, the crank angle detection means and the pressure detection means.

The present particular matter allows for acquisition with high accuracy and storage of fuel pressure detection data in the common rail—basic data for obtaining optimal fuel injection conditions (fuel injection time and amount) appropriate for the engine rpm, load, etc. For example, it is possible to readily recognize a variation pattern of the common rail fuel pressure correspondingly to the cylinder number and the crank angle, for example, by tabulating the stored detection data. This in turn makes it possible to build with precision a control program for properly controlling the common rail fuel pressure, and the fuel injection time and amount associated therewith, thus allowing highly efficient control over the engine operation.

It is to be noted that, as for the crank angle detection means, it may be possible to issue an output signal every given crank angle and have the common rail fuel pressure detected by pressure detection means in synchronization with the output signal transmission timing.

In the aforementioned solution means, the following is among configurations for extracting fuel pressure data in the common rail detected at specific timings. That is, the invention is based on a fuel pressure detector for a common rail type fuel injection apparatus, the fuel pressure detector disposed in the common rail type fuel injection apparatus for detecting the common rail fuel pressure, the common rail type fuel injection apparatus being equipped with a fuel pump for pressure-feeding fuel in a plurality of steps and raising the common rail fuel pressure to a given fuel injection pressure at the end of the final pressure feed step, a common rail for storing fuel pressure-fed from the fuel pump, and fuel injection valves for injecting fuel supplied from the common rail.

The fuel pressure detector comprises cylinder number judgment means for judging a cylinder number of the engine; crank angle detection means for detecting a crank angle; and pressure detection means for detecting the common rail fuel pressure every given crank angle in response to an output signal from the crank angle detection means. The fuel pressure detector further comprises storage means for storing the cylinder number, the crank angle and the common rail fuel pressure by associating them with one another in response to outputs from the cylinder number judgment means, the crank angle detection means and the pressure detection means. The fuel pressure detector yet further comprises data discrimination means for discriminating, from among data stored in the storage means, data related to the common rail fuel pressure during the time period from after fuel pressure feed in the step prior to the final pressure feed step until before fuel pressure feed in the next step (including the final pressure feed step).

The present particular matter ensures that data discriminated and extracted by data discrimination means is that which is detected when the common rail fuel pressure has not reached the fuel injection pressure and at the same time when fuel is not being pressure-fed into the common rail (non-pressure feed timing between adjacent pressure feed steps). That is, since the data is that which is detected at a timing when the common rail fuel pressure has not reached the fuel injection pressure, the pressure data is detected at a timing falling outside those timings when the common rail fuel pressure is likely to change suddenly as a result of execution of fuel injection and also when fuel is not being pressure-fed. As a result, the data is extracted as pressure data detected at a timing when the common rail fuel pressure undergoes relatively small changes. This allows extraction of common rail fuel pressure data detected with high accuracy.

Particularly, while the common rail fuel pressure data, detected as it has reached the fuel injection pressure, is acceptable when pressure detection is complete prior to start of fuel injection, the fuel pressure data may be that during or after fuel injection depending on the setting of fuel injection timing and therefore is not desired data. For this reason, the present solution means extract pressure data detected at a timing falling outside those timings when the common rail fuel pressure is likely to vary suddenly as a result of execution of fuel injection, thus allowing highly reliable pressure data to be obtained.

In extracting data detected at a timing when the common rail fuel pressure undergoes relatively small changes as described above, the following is among configurations for detecting optimal data. That is, the data discrimination means are configured so as to discriminate data related to the common rail fuel pressure during a time period from after fuel pressure feed one step prior to the final pressure feed step until before start of the final pressure feed step. That is, it is possible to extract pressure data detected when the common rail fuel pressure is relatively high (close to the fuel injection pressure) immediately before the final pressure feed step. That is, it is possible to obtain common rail fuel pressure data detected at the most reliable timing (timing when the pressure condition is closest to the fuel injection pressure) if the fuel injection pressure is estimated by common rail fuel pressure data detected at a timing when the pressure change is relatively small.

The above constitute the solution means for detecting the common rail fuel pressure every given crank angle.

A description will be given next of solution means for detecting the common rail fuel pressure at each elapse of a given time as alternative solution means provided to achieve the aforementioned object.

This solution is based on a fuel pressure detector for a common rail type fuel injection apparatus, the fuel pressure detector disposed in the common rail type fuel injection apparatus for detecting a common rail fuel pressure, the common rail type fuel injection apparatus being equipped with a fuel pump for pressure-feeding fuel, a common rail for storing fuel pressure-fed from the fuel pump, and fuel injection valves for injecting fuel supplied from the common rail. The fuel pressure detector comprises pressure detection means for detecting a common rail fuel pressure at each elapse of a given time; and storage means for storing the common rail fuel pressure at each elapse of a given time in response to output from the pressure detection means.

The present solution means also allows for acquisition with high accuracy and storage of common rail fuel pressure detection data—basic data for obtaining optimal fuel injection conditions (fuel injection time and amount) appropriate for the engine rpm, load, etc. It is to be noted that the given time intervals for detecting the common rail fuel pressure in the present solution means range between several tends of μsec and several msec (e.g., 5 msec).

On the other hand, in the aforementioned solution means for detecting the common rail fuel pressure every time a given time elapses, the following is among configurations for properly setting a detection start timing for the common rail fuel pressure. That is, the solution means, provided with crank angle detection means for detecting the crank angle, is designed to start, based on the crank angle, the detection start timing for detecting the common rail fuel pressure every time a given time elapses in response to output to pressure detection means from the crank angle detection means. That is, the solution means begin the operation for detecting the common rail fuel pressure from the moment when the crank angle reaches a given angle.

The present particular matter allows for acquisition of data based on temporal changes in common rail fuel pressure only over a necessary period of time, thus taking detection load off the control device and providing improved compatibility between obtained and desired data.

Further, the following configuration is among alternative means provided to achieve the aforementioned object. That is, the invention is based on a fuel pressure detector for a common rail type fuel injection apparatus, the fuel pressure detector disposed in the common rail type fuel injection apparatus for detecting the common rail fuel pressure, the common rail type fuel injection apparatus being equipped with a fuel pump for pressure-feeding fuel in a plurality of steps and raising the common rail fuel pressure to a given fuel injection pressure at the end of the final pressure feed step, a common rail for storing fuel pressure-fed from the fuel pump, and fuel injection valves for injecting fuel supplied from the common rail. The fuel pressure detector comprises crank angle detection means for detecting a crank angle; and pressure detection means for detecting, in response to an output signal from the crank angle detection means and every given crank angle, a common rail fuel pressure during the time period from after fuel pressure feed in the step prior to the final pressure feed step until before fuel pressure feed in the next step.

The present particular matter allows for detection of the common rail fuel pressure at a timing when the pressure change in the common rail is small as with the above means, thus providing improved detection accuracy in fuel pressure. In particular, being capable of detecting the common rail fuel pressure at a desired timing, namely, in a pinpoint manner, the present solution means are applicable, for example, to engine control based on the detection data.

In the above configuration, if the pressure detection means are configured to detect the common rail fuel pressure every given crank angle during a time period from after fuel pressure feed one step prior to the final pressure feed step until before start of the final pressure feed step, a pressure closer to the fuel injection pressure is detected as with the above means, thus providing improved detection accuracy in fuel pressure.

Meanwhile, a common rail type fuel injection apparatus, provided with the fuel pressure detector described in any one of the aforementioned solution means and configured to inject fuel supplied from the common rail to the combustion chamber by the fuel injection valves, is also included in the technical concept of the present invention.

BRIEF DESCRIPTION OF THE DRAWINGS

FIG. 11 illustrates a table stored in storage means.

BEST MODE FOR CARRYING OUT THE INVENTION

An embodiment of the present invention will be described below with reference to the drawings. In the present embodiment, a description will be given of application of the present invention to a common rail type fuel injection apparatus provided in the fuel supply system of a six-cylinder diesel engine.

Description of Common Rail Type Fuel Injection Apparatus

Figure 1:
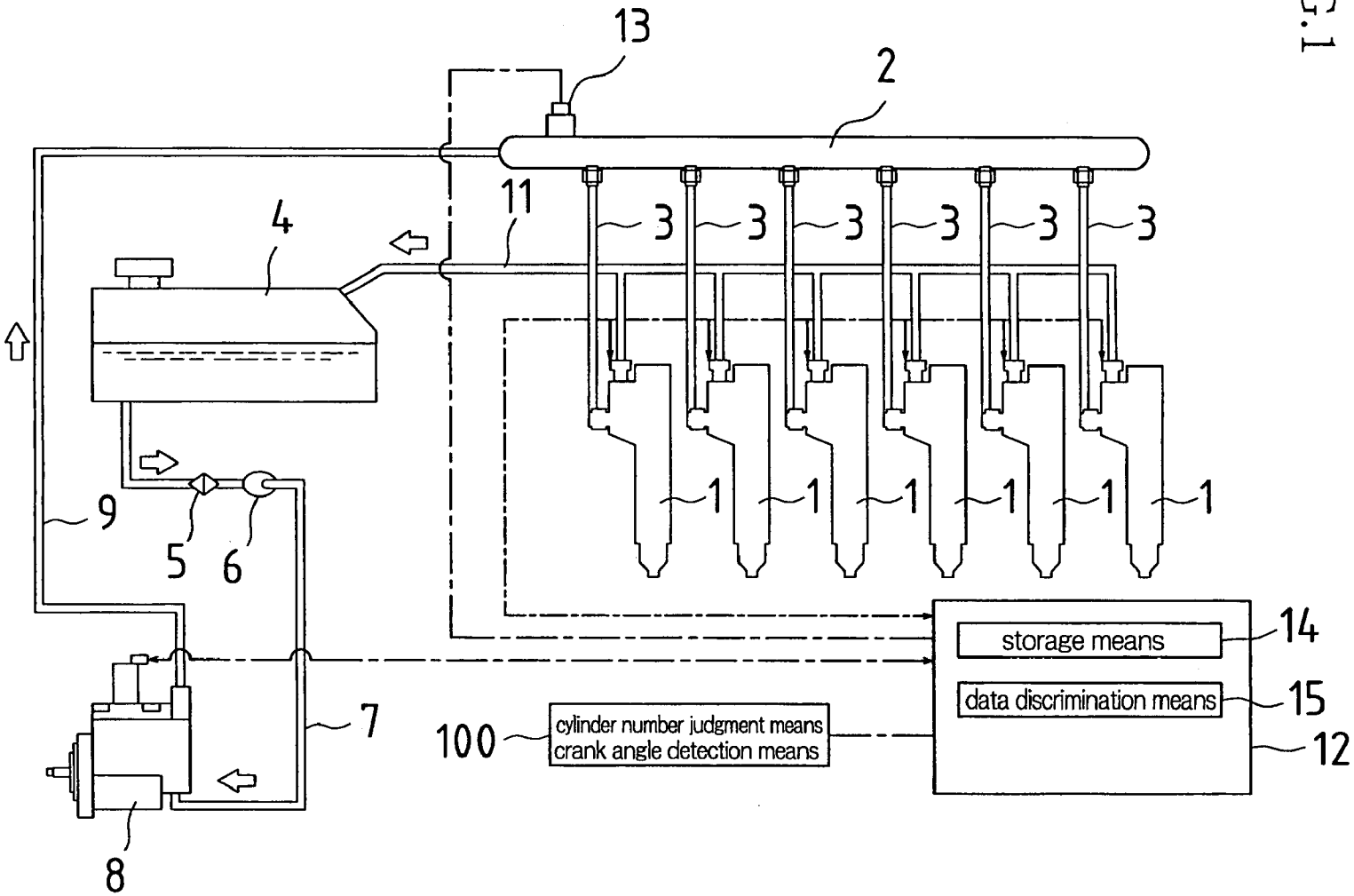
FIG. 1 illustrates a common rail type fuel injection apparatus according to an embodiment.
Figure 17:
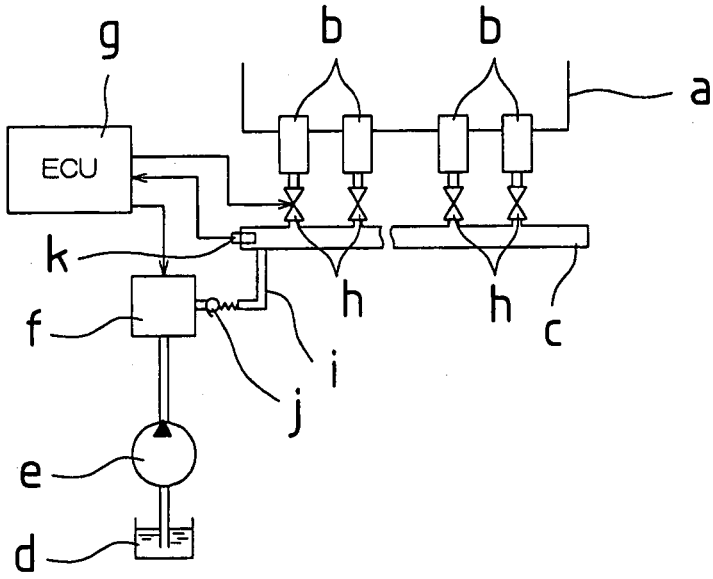
FIG. 17 illustrates a schematic view of the overall configuration of a fuel supply system in a multi-cylinder diesel engine equipped with a conventional common rail type fuel injection apparatus.

A description will be given first of the overall configuration of a common rail type fuel injection apparatus. FIG. 1 illustrates a common rail type fuel injection apparatus in a six-cylinder diesel engine. Detailed description of individual pieces of equipment constituting the common rail type fuel injection apparatus shown in the present figure will be omitted since they are approximately identical to those of the common rail type fuel injection apparatus described with reference to FIG. 17.

First, fuel supply to individual injectors 1 is carried out via branch pipes 3 constituting part of a fuel flow path from a common rail 2. Fuel, extracted from a fuel tank 4 via a filter 5 by a feed pump (the low-pressure pump) 6 and pressurized to a given inlet pressure, is sent to a high-pressure pump (fuel pump) 8 via a fuel pipe 7. The high-pressure pump 8 is a so-called plunger type fuel supply pump that is driven, for example, by the engine to raise the fuel pressure to a high pressure determined based on the driving condition and supplies fuel to the common rail 2 via a fuel pipe 9. It is to be noted that the detailed configuration of the high-pressure pump 8 will be described later.

Fuel, supplied to the high-pressure pump 8, is stored in the common rail 2 under a given pressure and supplied to the individual injectors 1, 1, . . . from the common rail 2. The injectors 1 are provided in plurality according to the engine type (number of cylinders; six cylinders in the present embodiment) and inject, under the control of a controller 12, fuel supplied from the common rail 2 to the corresponding combustion chamber at the optimal injection time and in the optimal injection amounts. Since the injection pressure at which fuel is injected from the injectors 1 is approximately equal to the pressure of fuel stored in the common rail 2, the common rail 2 pressure is controlled to control the fuel injection pressure.

Of fuel supplied to the injectors 1 from the branch pipes 3, that which is not spent on injection to the combustion chamber is returned to the fuel tank 4 via a return pipe 11.

The controller 12, an electronic control unit, contains cylinder number and crank angle information that has been input to it.

The controller 12 has target fuel injection conditions (e.g., target fuel injection time, target fuel injection amount, target common rail pressure)—the conditions determined in advance based on the engine operating conditions so as to ensure that the engine puts out the optimal output adapted to its operating conditions stored in it as a map or function and calculates target fuel injection conditions (namely, fuel injection timing and amount by the injectors 1) correspondingly to signals detected by various sensors and representing the current engine operating conditions, thus controlling the activation of the injectors 1 and the common rail fuel pressure such that fuel injection is carried out under those conditions. The common rail 2 is provided with a pressure sensor 13, sending the pressure detection signal in the common rail 2 detected by the pressure sensor 13 to the controller 12. A description will be given later of the timing at which the detection signal is transmitted from the pressure sensor 13 to the controller 12.

Even as fuel in the common rail 2 is consumed as a result of injection from the injectors 2, the controller 12 controls the discharge of the high-pressure pump 8 so as to maintain the fuel pressure in the common rail 2 constant.

The common rail fuel injection apparatus is thus configured to accumulate discharged fuel, pressure-fed from the high-pressure pump 8, in the common rail 2 and drive the injectors 1 so as to inject fuel at a proper fuel injection timing (fuel injection time) and in proper fuel injection amounts (common rail fuel pressure and fuel injection time). To control the common rail fuel pressure, the apparatus controls the high-pressure pump 8 in accordance with fuel injection from the injectors to pressure-feed fuel and at the same time controls the amount of fuel pressure-fed, thus keeping the common rail pressure constant with no pressure drops.

Description of the High-Pressure Pump 8

Figure 2:
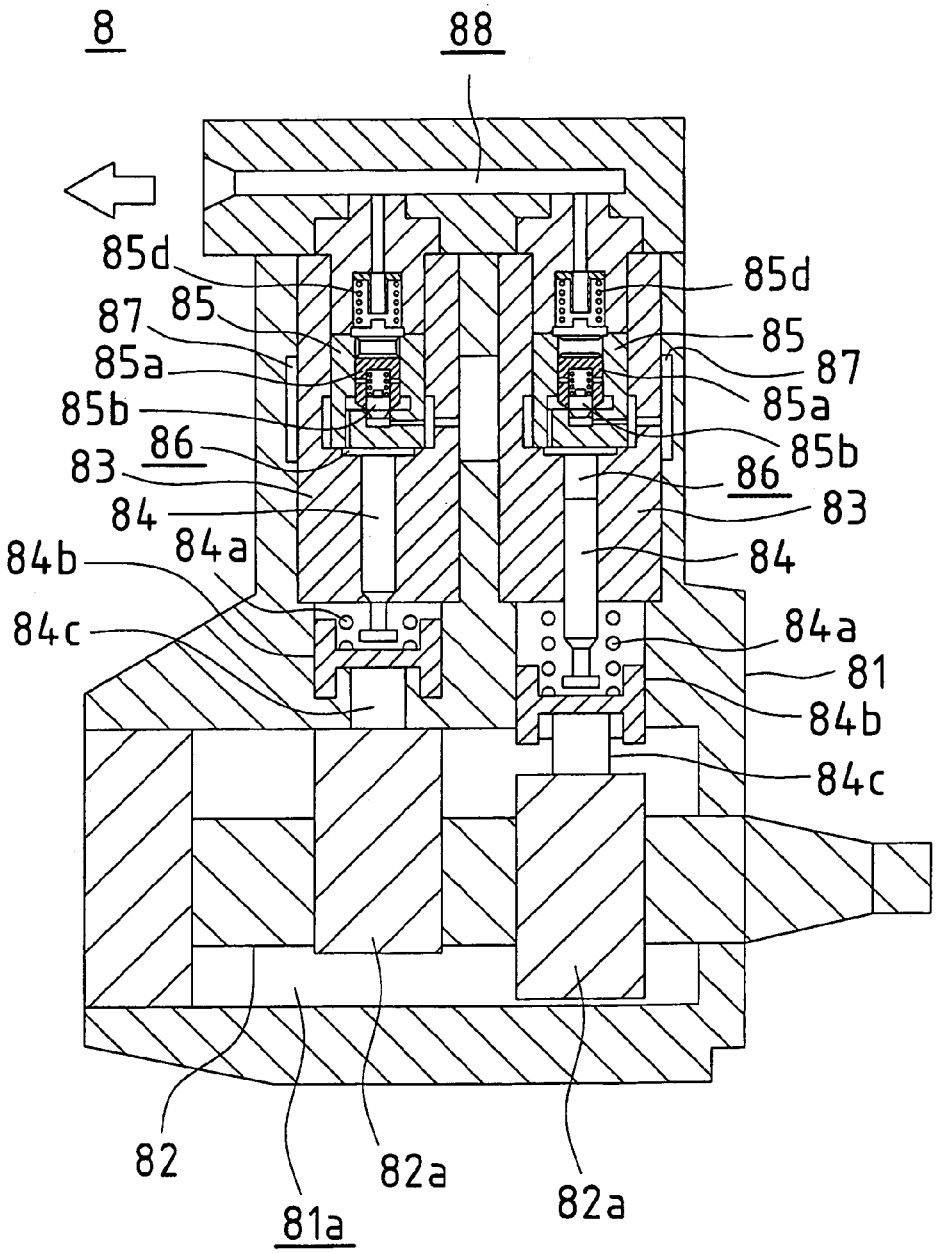
FIG. 2 is a sectional view of a high-pressure pump as seen from its side.
Figure 3:
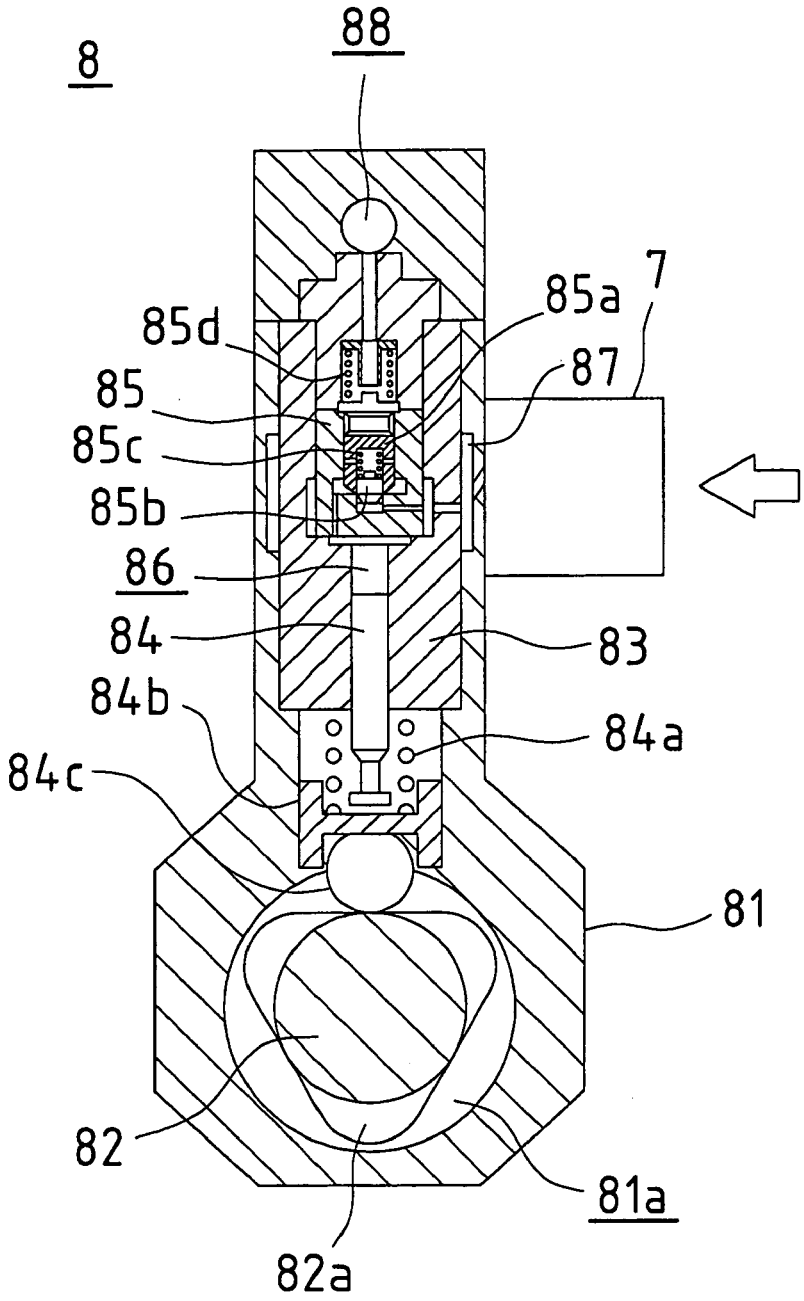
FIG. 3 is a sectional view of the high-pressure pump as seen from its front.

Next, the high-pressure pump 8 will be described. FIG. 2 is a sectional view of the high-pressure pump 8 as seen from its side, whereas FIG. 3 is a sectional view of the high-pressure pump 8 as seen from its front.

As shown in these figures, the high-pressure pump 8 has a cam chamber 81*a* formed at the lower end portion of a pump housing 81. A cam shaft 82, that is powered by a crank shaft not shown and rotates at the same rpm as that of the crank shaft, is inserted in the cam chamber 81*a*, and a pair of cams 82*a*, 82*a* is formed on the cam shaft 82 axially with a given space between them. The cams 82*a* are formed by three-crest cams so as to perform three upstrokes (discharge strokes of high-pressure fuel associated with rise of plungers 84 described later) per rotation of the cam shaft 82, with the cam lift phases of the individual cams 82*a*, 82*a* being 120 degrees apart. This causes each of the cams 82*a*, 82*a* to perform three upstrokes per rotation of the cam shaft 82, resulting in a total of six upstrokes being carried out. Since the crank shaft makes two rotations per engine cycle, the cam shaft 82 also makes two rotations per cycle in synchronization therewith, resulting in 12 upstrokes being carried out per cycle. That is, fuel is pressure-fed 12 times to the common rail 2. As described above, since the engine according to the present embodiment is a six-cylinder engine, fuel pressure feed is performed in two steps to the common rail 2 during the time period from fuel injection to one cylinder to fuel injection to another cylinder. Two-step fuel pressure feed is intended to minimize the peak drive torque value needed to rotate the cam shaft 82. That is, to boost the common rail fuel pressure to the fuel injection pressure by a single-step pressure feed, the peak drive torque value for rotating the cam shaft 82 becomes considerably high, resulting in a tendency toward larger loss of power for driving the high-pressure pump 8. To avoid this, fuel is pressure-fed in two separate steps in the present embodiment. It is to be noted that the peak drive torque value can be further suppressed if fuel is pressure-fed in three or more separate steps.

On the other hand, a pair of plunger barrels 83, 83 is provided inside the upper portion of the pump housing 81, with the plungers 84, 84 inserted in the lower halves of the plunger barrels 83, 83. Inside the upper halves of the plunger barrels 83, 83, there are provided discharge valves 85*a* accommodated in valve housings 85, 85 and check valves 85*b* inserted in the discharge valves 85*a*.

The plungers 84 are cylindrical in shape and fitted into the plunger barrels 83 so as to be free to make reciprocating motion in the vertical direction in the figure. A plunger chamber 86 is formed between the upper end surface of each of the plungers 84 and each of the valve housings 85. The plunger chamber 86 communicates with the upper space of the check valve 85*b* (space between the check valve 85*b* and the discharge valve 85*a*) accommodated inside the valve housing 85. The plunger chamber 86 is under low pressure when the plunger 84 is at the bottom dead center (the state of the plunger 84 on the right in FIG. 2), whereas the plunger chamber 86 is under high pressure when the plunger 84 is at the top dead center (the state of the plunger 84 on the left in FIG. 2).

There is provided, under the plunger 84, a slider 84*b* biased downward by a return spring 84*a*. The slider 84*b* has a cam roller 84*c*. The cam roller 84*c* slidingly contacts the outer surface of the cam 82*a*. Therefore, as the cam 82*a* rotates as a result of rotation of the cam shaft 82, the plunger 84 makes vertical reciprocating motion via the cam roller 84*c* and the slider 84*b*. This causes the plunger chamber 86, as described above, to be under low pressure when the plunger 84 is at the bottom dead center (the state of the plunger 84 on the right in FIG. 2) and to be under high pressure when the plunger 84 is at the top dead center (the state of the plunger 84 on the left in FIG. 2). It is to be noted that the reciprocating stroke of the plunger 84 is determined by the difference of height of the cam 82*a*.

The fuel pipe 7 extending from the fuel tank 4 communicates with a fuel introducing path 87 that is formed spanning from the pump housing 81 and the plunger barrel 83 to the valve housing 85. The inner pressure of the fuel introducing path 87 acts on the lower end of the check valve 85*b* within the valve housing 85. It is to be noted that downward biasing force acts on the check valve 85*b* and the discharge valve 85*a* by return springs 85*c* and 85*d*. For this reason, when the pressure of the upper side of the check valve 85*b* (pressure in the space communicating with the plunger chamber 86) drops by a given pressure below the pressure of the fuel introducing path 87 as the plunger 84 lowers, then the check valve 85*b* opens against the biasing force of the return spring 85*c*, introducing fuel from the fuel introducing path 87 into the plunger chamber 86.

On the other hand, when the pressure of the upper side of the check valve 85*b* (pressure in the space communicating with the plunger chamber 86) increases by a given pressure above the pressure of the fuel introducing path 87 as the plunger 84 rises, then the check valve 85*b* closes the fuel introducing path 87 by the pressure thereof and the biasing force of the return spring 85*c*, and at the same time the discharge valve 85*a* opens against the biasing force of the return spring 85*d*, allowing fuel to be injected from the plunger chamber 86 to the fuel pipe 9 via a discharge flow path 88 at the upper portion of the pump housing 81. Fuel, brought under high pressure as a result of the reciprocating motion of the plungers 84, 84, is intermittently pressure-fed into the common rail 3 via the discharge flow path 88 and the fuel pipe 9.

Crank Angle Recognition Device

A description will be given next of the configuration of a crank angle recognition device—a device that transmits crank angle and cylinder number information to the controller 12. In the present embodiment, the crank angle identification device combines two capabilities: crank angle detection capability (capability referred to as "crank angle detection means" in the present invention) and cylinder number discrimination capability (capability referred to as "cylinder number judgment (discrimination) means" in the present invention).

Figure 4:
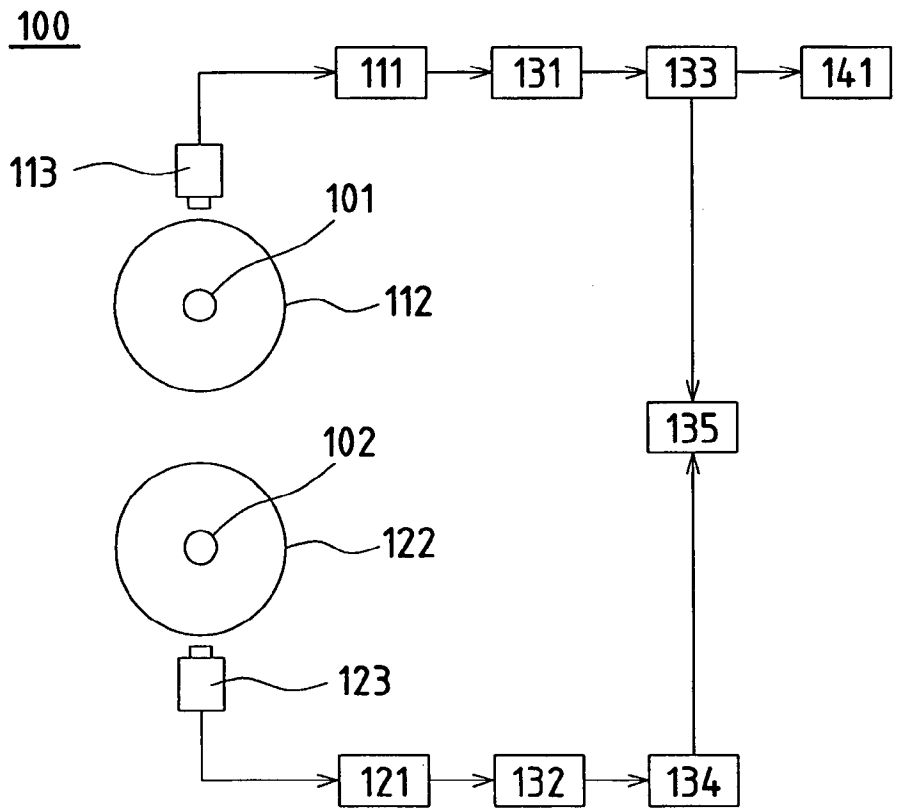
FIG. 4 is a block diagram showing a schematic configuration of a crank angle identification device.
Figure 5:
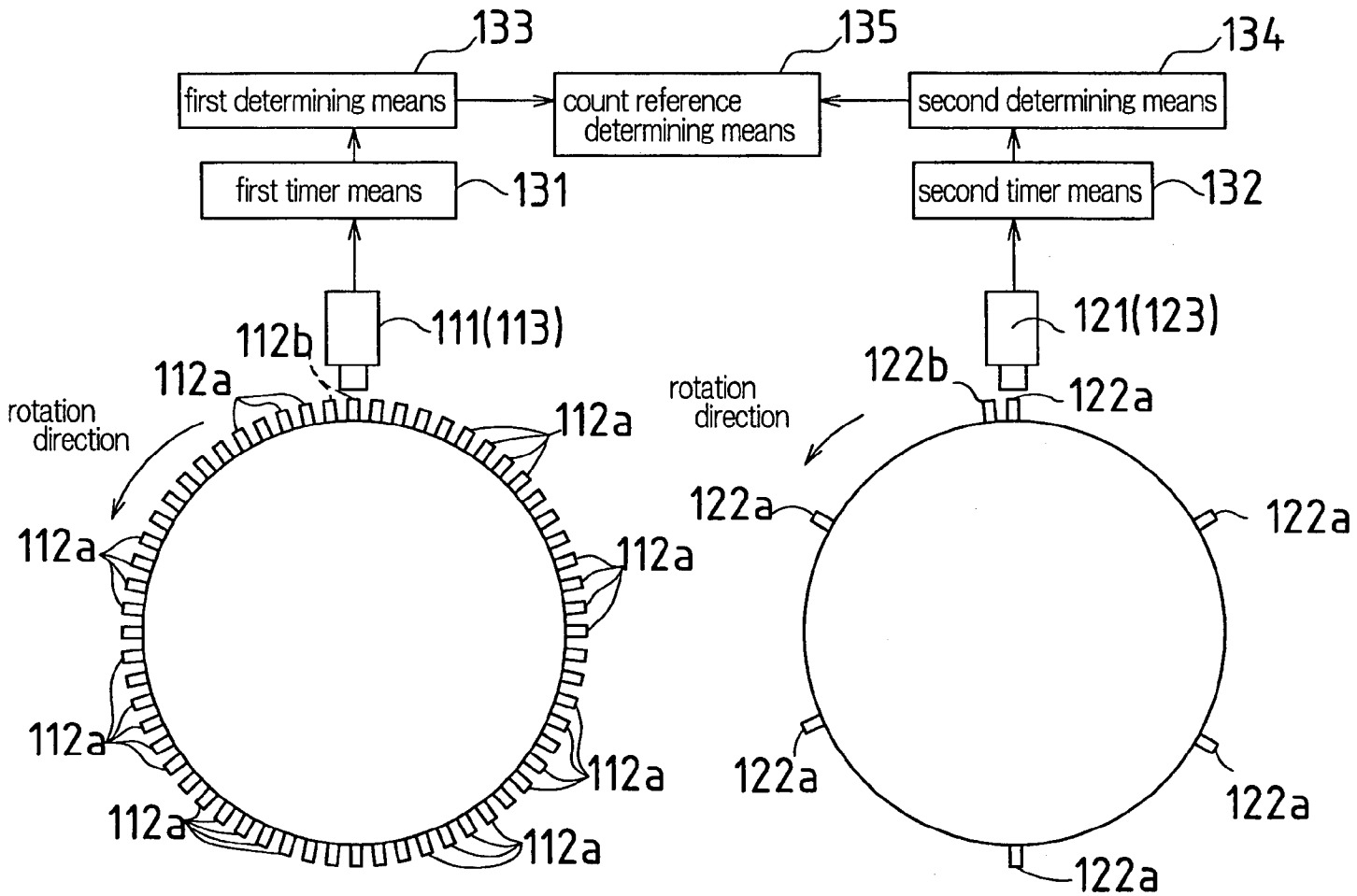
FIG. 5 is a basic configuration diagram of the crank angle identification device schematically showing first and second detection means.

FIG. 4 is a functional block diagram showing a schematic configuration of a crank angle identification device 100, whereas FIG. 5 is a configuration diagram schematically showing first and second detection means in FIG. 4.

In FIGS. 4 and 5, 101 and 102 are respectively an engine crank shaft and a cam shaft for inlet and outlet valves, and the cam shaft 102 is designed to be rotated by a mechanism not shown synchronously with the crank shaft 101 at a 1:2 speed reducing ratio.

The crank shaft 101 is provided with first signal detection means 111 for obtaining first and second detection signals for every predetermined angle related to the rotation of the crank shaft 101. The first signal detection means 111 are provided with a crank shaft synchronous rotating body 112 that is connected, for integral rotation, to and rotates synchronously with the crank shaft 101, a plurality of protrusions 112*a*, . . . each provided at every given angle along the outer perimeter of the crank shaft synchronous rotating body 112 and an electromagnetic pickup type first detector 113.

Figure 6:
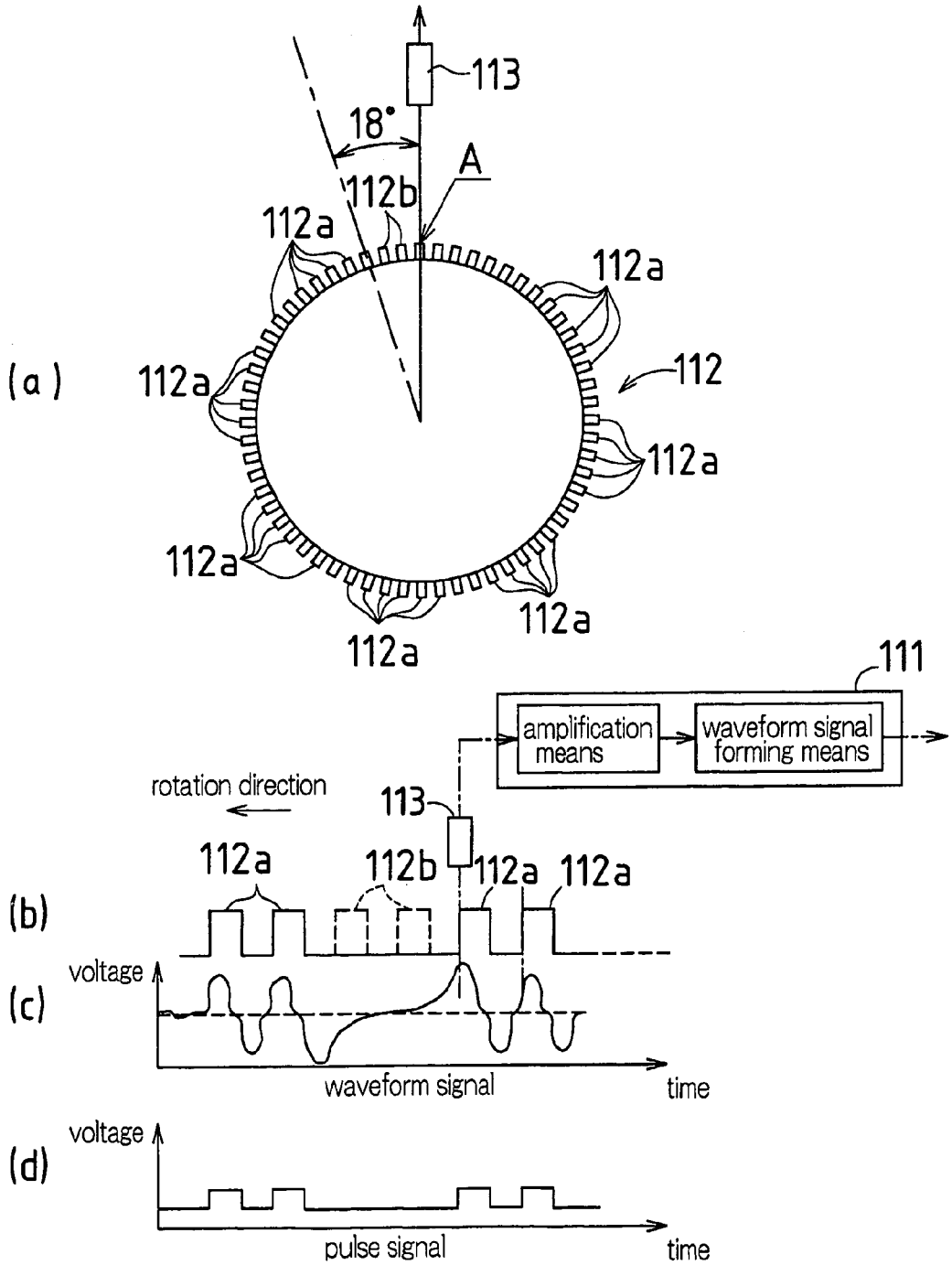
FIG. 6(*a*) is an explanatory view showing a reference position of the crank angle by the first detection means, FIG. 6(*b*) is a development view of a protrusion on a crank shaft synchronous rotating body, FIG. 6(*c*) illustrates a waveform signal formed by amplifying an electromagnetic pickup output signal detected by a first detector, and FIG. 6(*d*) illustrates a rectangular wave pulse converted from the waveform signal.

The protrusions 112*a* of the crank shaft synchronous rotating body 112 are protruded radially outward every 6° crank angle, with an extremely small space between each of the protrusions 112*a*, 112*a* and its adjacent protrusion 112*a*—the space that roughly matches the circumferential width of the protrusion 112*a*, and two of the protrusions 112*a*, 112*a* are continually missing (these missing protrusions are referred to as missing protrusions 112*b*) before a crank angle reference position A (refer to FIG. 6). In this case, although the protrusions 112*a*, . . . are provided every 6° crank angle along the circumference of the crank shaft synchronous rotating body 112, there are 58 pieces of the protrusions 112*a* that are protruded, with the two missing protrusions 112*b*, 112*b* subtracted from the count. The first detection signal for every predetermined angle is a short-interval detection signal every 6° crank angle that is output each time the protrusion 112*a* is detected along the circumference of the crank shaft synchronous rotating body 112. The signal is detected 58 times when the crank shaft synchronous rotating body 112 makes one rotation. On the other hand, the second detection signal for every predetermined angle is a long-interval detection signal that detects the two missing protrusions 112*b* that are continually missing along the circumference of the crank shaft synchronous rotating body 112. The signal is detected only once when the crank shaft synchronous rotating body 112 makes one rotation.

The cam shaft 102 is provided with a second signal detection means 121 for obtaining third and fourth detection signals for every predetermined angle related to the rotation of the cam shaft 102. The second signal detection means 121 are provided with a cam shaft synchronous rotating body 122 that is connected, for integral rotation, to the end of and rotates synchronously with the cam shaft 102, a plurality of protrusions 122*a*, . . . each provided at every given angle along the outer perimeter of the cam shaft synchronous rotating body 122 and an electromagnetic pickup type second detector 123.

The protrusions 122*a* of the cam shaft synchronous rotating body 122 are protruded radially outward at positions roughly corresponding to intervals of 60° cam angle along the circumference of the cam shaft synchronous rotating body 122. A single protrusion 122*b* is protruded before a cam angle reference position B and more specifically 6° cam angle away from and before the protrusion 122*a* of the cam angle reference position B. In this case, the six protrusions 122*a*, . . . , the number corresponding to the number of engine cylinders, are protruded along the circumference of the cam shaft synchronous rotating body 112.

Figure 7:
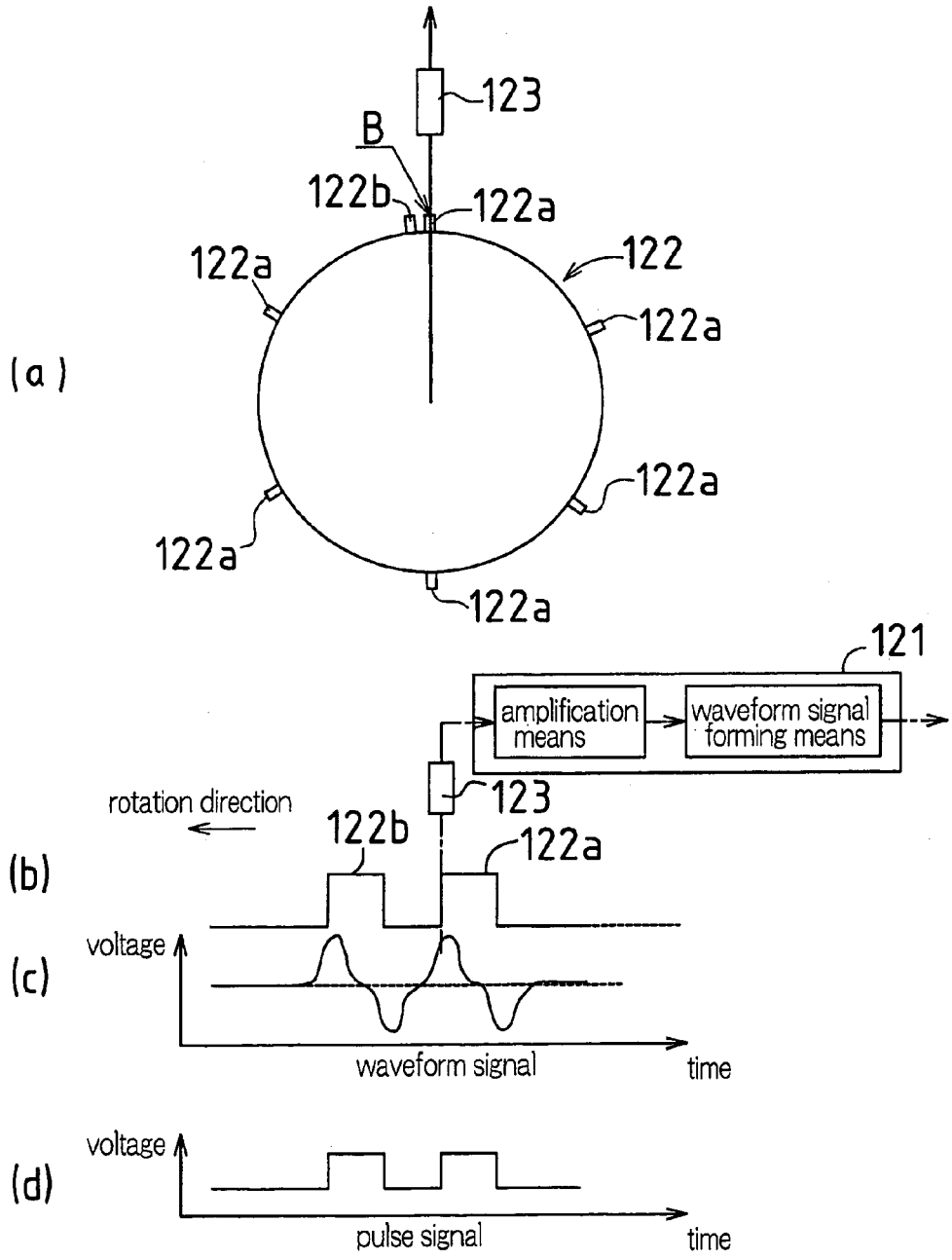
FIG. 7(*a*) is an explanatory view showing a reference position of the crank angle by the second detection means, FIG. 7(*b*) is a development view of a protrusion on a cam shaft synchronous rotating body, FIG. 7(*c*) illustrates a waveform signal formed by amplifying an electromagnetic pickup output signal detected by a second detector, and FIG. 7(*d*) illustrates a rectangular wave pulse converted from the waveform signal.

The third detection signal for every predetermined angle is a constant-interval detection signal corresponding to each cylinder that is output each time the protrusion 122*a* is detected along the circumference of the cam shaft synchronous rotating body 122. The signal is detected six times when the cam shaft synchronous rotating body 122 makes one rotation. On the other hand, the fourth detection signal for every predetermined angle is a short-interval double-pulse specified detection signal that is continually detected twice because of the protrusion 122*a* of the cam angle reference position B and the protrusion 122*b* that is protruded therebefore. The signal is detected only once (double pulse) when the cam shaft synchronous rotating body 122 makes one rotation. In this case, as shown in FIG. 6(*a*), and FIG. 6(*b*) that is a development view of FIG. 6(*a*) as well as FIG. 7(*a*), and FIG. 7(*b*) that is a development view of FIG. 7(*a*), the detection signals (electromagnetic pickup output signals) detected by the first detector 113 or second detector 123 are amplified by amplification means first and then converted to rectangular pulse signals by waveform signal forming means, both means in the signal detection means 111 or 121. FIGS. 6(*c*) and 7(*c*) and FIGS. 6(*d*) and 7(*d*) show the outputs of the amplification means and the waveform signal forming means, respectively. These pulse signals correspond respectively to the protrusions 112*a*, 122*a* and 122*b*.

In FIG. 4, 131 is first timer means as first measurement means, and the first timer means 131 measure, in response to output from the first detector 113, the time interval between occurrences of the first and second detection signals obtained based on the crank shaft synchronous rotating body 112.

On the other hand, 132 is second timer means as second measurement means, and the second timer means 132 measure, in response to output from the second detector 123, the time interval between occurrences of the third and fourth detection signals obtained based on the cam shaft synchronous rotating body 122.

Figure 8:
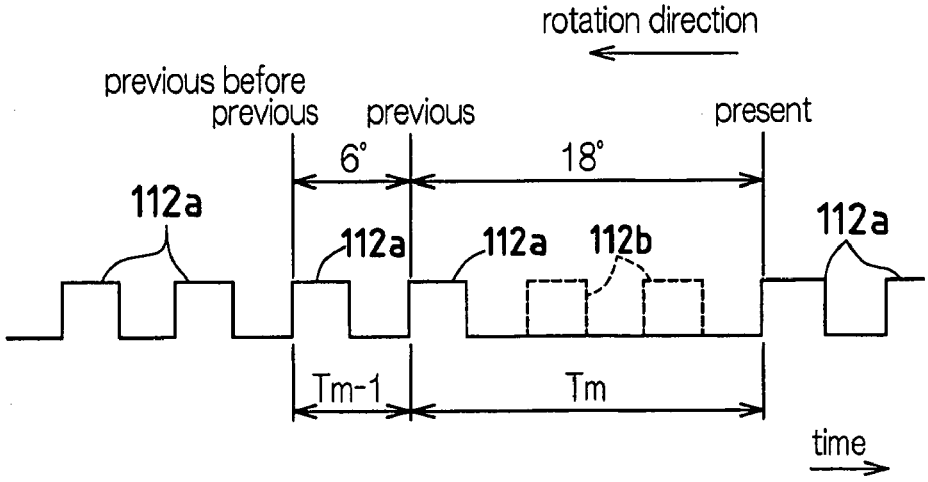
FIG. 8 is a pulse signal waveform diagram describing the basis for determining of a first or second detection signal by first determining means.

Meanwhile, 133 is first determining means, and as shown in FIG. 8, the first determining means 133 compare, in response to output from the first timer means 131, a time interval between occurrences of the present and previous detection signals detected by the first timer means 131—a time interval Tm between occurrences of the two detection signals spanning from the protrusion 112*a*, 112*a* to its adjacent one—with an immediately previous time interval between occurrences of the previous detection signal and the previous before previous detection signal—a time interval Tm−1 between occurrences of the two detection signals spanning from the protrusion 112*a*, 112*a* to its adjacent one, determining whether the detection signal detected by the first timer means 131 is the first detection signal for every predetermined angle (detection signal every 6° crank angle) or the second detection signal for every predetermined angle (specified detection signal for detecting the missing protrusions 112*b* once per rotation). In this case, the first determining means 133 compare the time interval Tm and the immediately previous time interval Tm−1 between occurrences of the detection signals detected by the first timer means 131, determining that the present detection signal is the second detection signal for every predetermined angle (specified detection signal by the missing protrusions 112*b*) when the relationship of $2 \leqq Tm/Tm-1 \leqq 4$ is satisfied. It is to be noted that "2" and "4" that prescribe the range of Tm/Tm−1 are variables that can be varied depending on the engine operating conditions such as engine load, whether or not the engine has just started or acceleration/deceleration.

Figure 9:
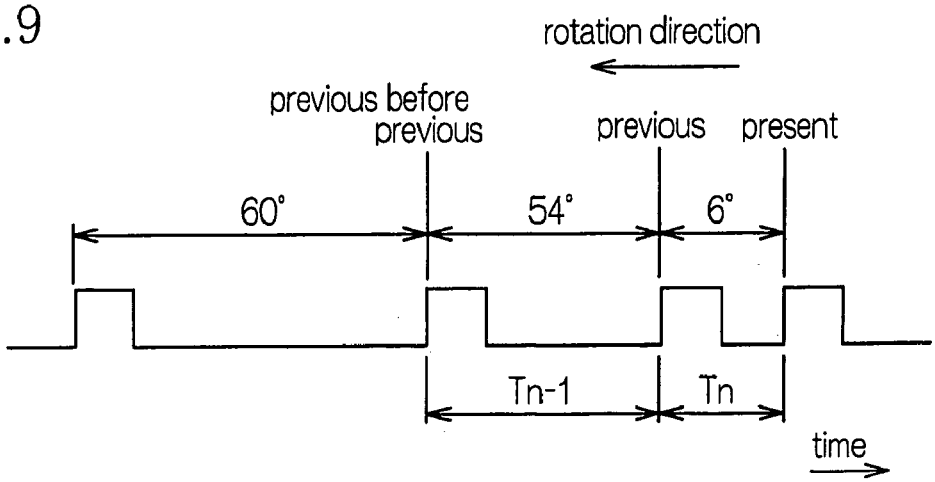
FIG. 9 is a pulse signal waveform diagram describing the basis for determining of a third or fourth detection signal by second determining means.

On the other hand, 134 is second determining means, and as shown in FIG. 9, the second determining means 134 compare, in response to output from the second timer means 132, a time interval between occurrences of the present and previous detection signals detected by the second timer means 132—a time interval Tn between occurrences of the two detection signals spanning from the protrusion 122*a*, 122*a* to its adjacent one—with an immediately previous time interval between occurrences of the previous detection signal and the previous before previous detection signal—a time interval Tn−1 between occurrences of the two detection signals spanning from the protrusion 122*a*, 122*a* to its adjacent one, determining whether the detection signal detected by the second timer means 132 is the third detection signal for every predetermined angle (cylinder detection signal corresponding to each cylinder) or the fourth detection signal for every predetermined angle (double-pulse specified detection signal once per rotation). In this case, the second determining means 134 compare the time interval Tn and the immediately previous time interval Tn−1 between occurrences of the detection signals detected by the second timer means 132, determining that the present detection signal is the fourth detection signal for every predetermined angle (double-pulse specified detection signal) when the relationship of $0.1 \leqq Tn/Tn-1 \leqq 0.5$ is satisfied. It is to be noted that "0.1" and "0.5" that prescribe the range of Tn/Tn−1 are variables that can be varied depending on the engine operating conditions such as engine load, whether or not the engine has just started or acceleration/deceleration.

Figure 10:
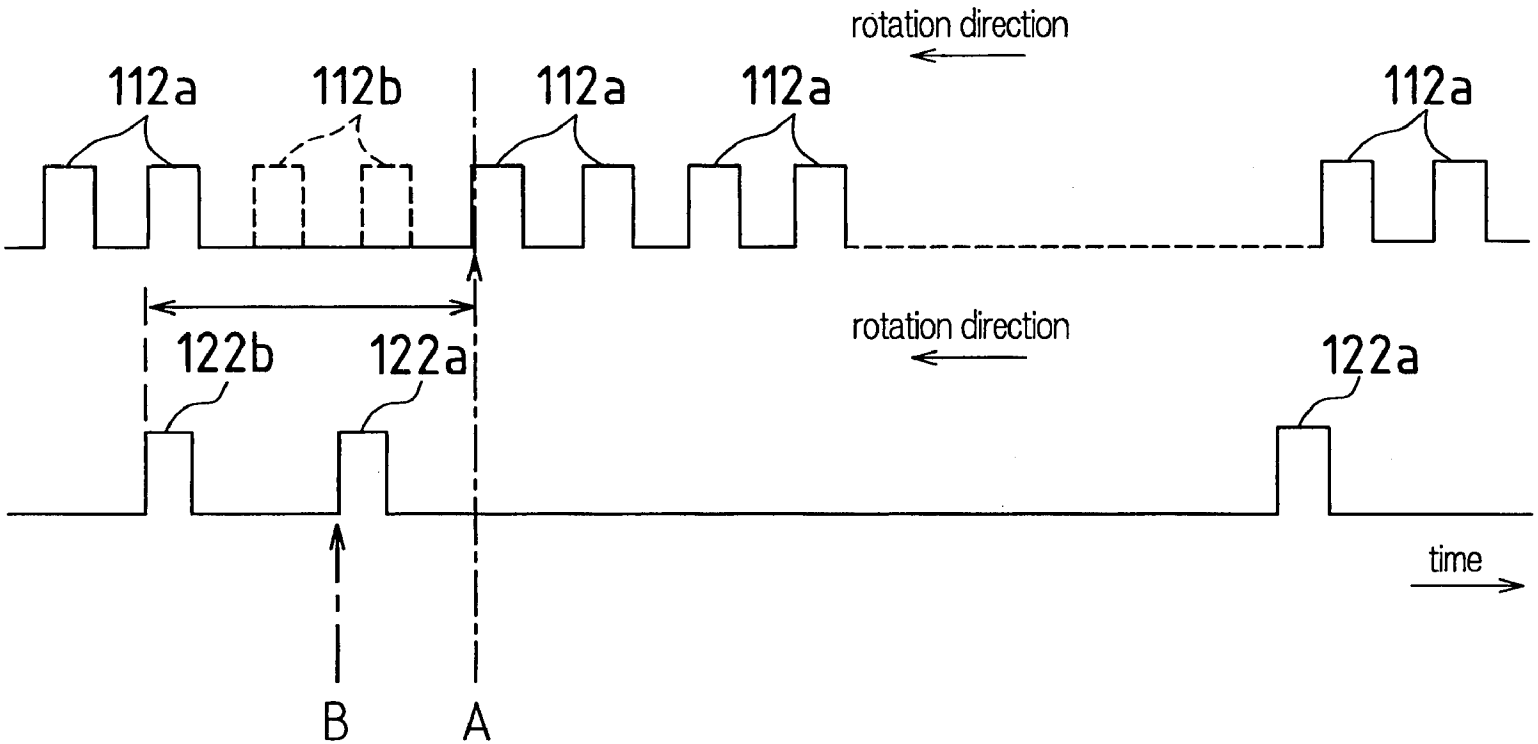
FIG. 10 is a pulse signal waveform diagram describing the basis for determining of crank angle count reference by count reference determining means.

And, 135 is count reference determining means, and the count reference determining means 135 determine, in response to outputs from the first and second determining means 133 and 134, that the occurrence timing of the first detection signal measured first by the first timer means 131 is a crank angle count reference A (crank angle reference position A) as shown in FIG. 10, when the detection signal is judged by the first determining means 133 as the second detection signal for every predetermined angle (specified detection signal once per rotation) and by the second determining means 134 as the fourth detection signal for every predetermined angle (double-pulse specified detection signal) within a given angle (e.g., within 30°) of the crank shaft synchronous rotating body 112. In this case, the crank angle count reference A (crank angle reference position A) is, as shown in FIG. 6A, stipulated to be the leading edge position of the pulse signal (the protrusion 112*a*) in the rotation direction of the crank shaft synchronous rotating body 112. On the other hand, the cam angle reference position B is, as shown in FIG. 7A, stipulated to be the leading edge position of the pulse signal (the protrusion 122*a*) in the rotation direction of the cam shaft synchronous rotating body 122.

In FIG. 4, 141 is count means, and the count means 141 count, in response to output from the first determining means 133, occurrences of the first detection signal based on the crank shaft synchronous rotating body 112 each time the signal occurs. The count means 141 are designed to be reset when the number of occurrences of the first signal based on the crank shaft synchronous rotating body 112 reaches a given value. The given value for resetting the count means 141 is determined to be when the number of occurrences of the first signal based on the crank shaft synchronous rotating body 112 reaches a value equivalent to the rotation of a cylinder, namely, "20."

It is to be noted that if the value is equivalent to the rotation of a cylinder that matches the two missing protrusions 112*b*, the count means 141 are reset when "18"—value derived by subtracting two pulses—is reached. The cylinder number is successively updated (1->2->3->4->5->6->1-> . . . ) each time the count means 141 are reset. That is, the cylinder number to be recognized is successively updated when the number of occurrences of the detection signal based on the crank shaft synchronous rotating body 112 reaches "20" or "18."

The above configuration allows for crank angle and cylinder number information to be obtained, thus transmitting these pieces of information to the controller 12.

Description of the Configuration of the Fuel Pressure Detector

A description will be given next of the configuration of the fuel pressure detector provided in the common rail fuel injection apparatus—the feature of the fuel pressure detector. The fuel pressure detector comprises the crank angle identification device 100 having the cylinder number discrimination capability and the crank angle detection capability described earlier, the pressure sensor 13 as pressure detection means and storage means 14 provided in the controller 12.

As shown in FIG. 1, the storage means 14, provided in the controller 12, store a cylinder number, a crank angle and a common rail fuel pressure, in response to output signals from the crank angle identification device 100 having the cylinder number discrimination capability and the crank angle detection capability and the pressure sensor 13, by associating these pieces of information together. More specifically, the pressure sensor 13 detects the common rail fuel pressure every 6° crank angle and sends the pressure detection result to the storage means 14.

Then, the storage means 14 creates a table as shown in FIG. 11 by associating the pressure detection data (common rail fuel pressure data) with the cylinder number and the crank angle and store the table.

The table consists of k rows and n columns, with the columns representing crank angles POS ((1-20=n): 20 or 18 pulses per cylinder) and the rows representing cylinder numbers CYL (1-6=k). This provides unified control over common rail fuel pressure data according to the conditions of the individual cylinders (stroke position such as piston top or bottom dead center) and the crank shaft's crank angle. Each time pressure detection data is detected, the data is written successively to the corresponding block in the table (data write area in the table corresponding to the recognized cylinder number and crank angle (pulse count) at the timing of pressure detection), thus updating the table. Alternatively, a new table may be successively created each time the crank shaft makes two rotations. That is, tables are created one after another.

Common Rail Fuel Pressure Detection Operation

A description will be given below of the common rail fuel pressure detection operation by the thus configured fuel pressure detector provided in the common rail fuel injection apparatus.

Figure 12:
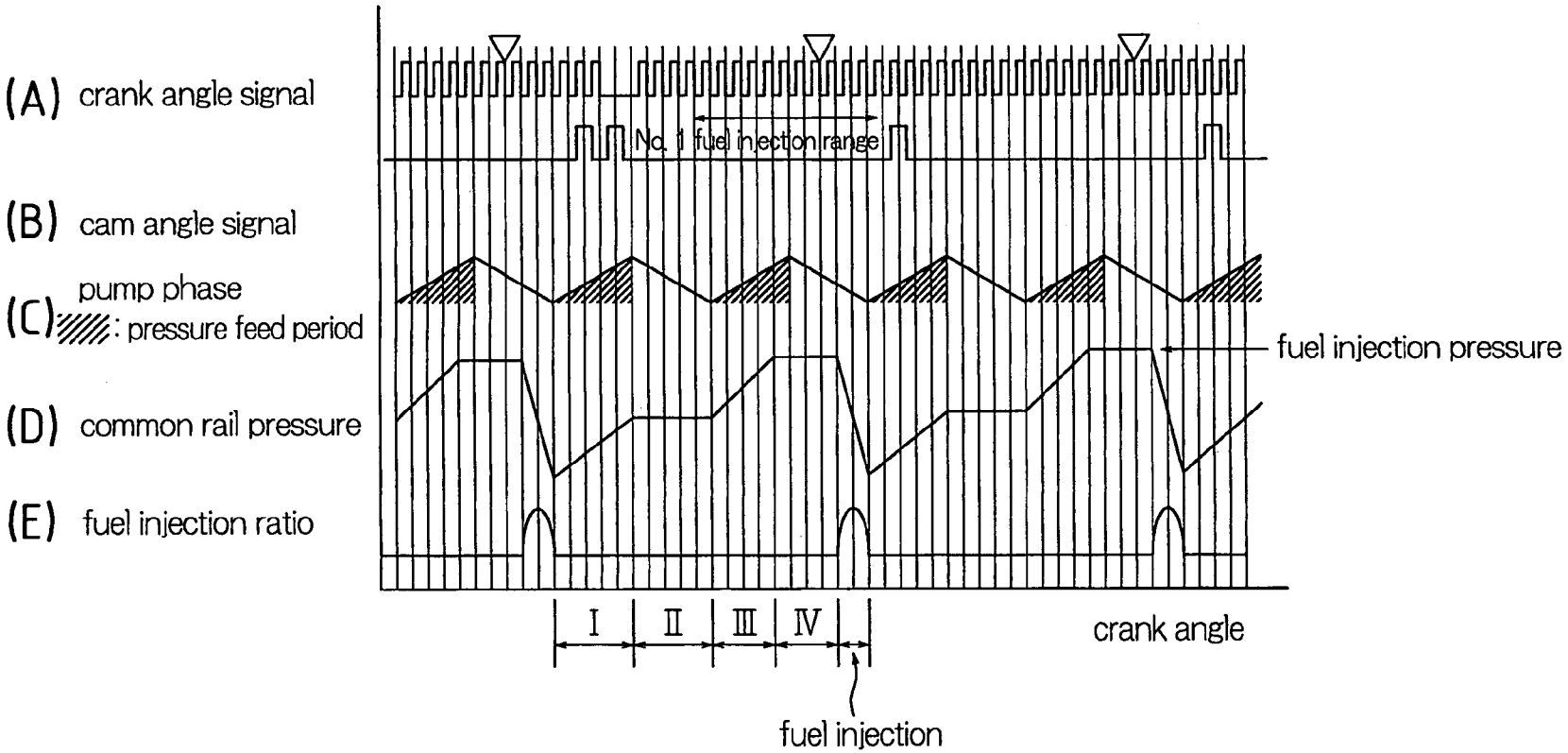
FIG. 12 are timing charts showing various waveforms detected as a result of engine operation.

FIG. 12 is a timing chart showing various waveforms detected as a result of engine operation. (A) in the figure is a crank angle signal waveform transmitted by the crank angle sensor (constituted by the crank angle identification device 100), whereas (B) is a cam angle signal waveform transmitted by the cam angle sensor (constituted by the crank angle identification device 100) (the waveforms are approximately identical to those in FIG. 10). On the other hand, (C) illustrates the phase shift status of the high-pressure pump 8, with the shaded areas representing the pressure feed steps. That is, one cycle (one crest) of the waveform (C) represents the discharge operation of high-pressure fuel by one reciprocating motion of the plunger 84 of the high-pressure pump 8. Meanwhile, (D) is a waveform showing the changes in the common rail fuel pressure obtained by plotting the common rail fuel pressure detected every given crank angle (6°). That is, the pressure sensor 13 detects the common rail fuel pressure at the trailing edges of the waveform (A) pulse (detection conducted similarly when the missing protrusions 112*b* pass), and the waveform (D) is created based on the pressure detection results. On the other hand, (E) is a waveform illustrating the fuel injection ratio that represents the injection timings of the injectors 1.

As shown in the figure, the common rail fuel pressure repeatedly undergoes changes, reaching a given fuel injection pressure after two pressure feed steps and then slipping suddenly as a result of fuel injection by one of the injectors 1 (configuration already described for performing the two pressure feed steps).

Here, a first pressure feed step (step indicated by I in FIG. 12) after fuel injection by the injector 1 is called the first pressure feed step, whereas a second pressure feed step (step indicated by III in FIG. 12) is called the second pressure feed step. Meanwhile, a non-pressure feed step between the first and second pressure feed steps is referred to as an intermediate pressure step (step indicated by II in FIG. 12), whereas a non-pressure feed step between the end of the second pressure feed step and the start of fuel injection (step indicated by IV in FIG. 12) is referred to as an injection pressure step. That is, the common rail fuel pressure gradually rises in the first and second pressure feed steps I and III, but abruptly declines at the fuel injection timing as a result of fuel injection by the injector 1. On the other hand, the common rail fuel pressure remains relatively stable in the intermediate pressure step II and the injection pressure step IV.

In the present embodiment, the pressure sensor 13 detects the common rail fuel pressure every 6° crank angle as described above, namely, synchronously with the trailing edges of the crank angle signal (A) pulse in FIG. 12 and sends the pressure detection results to the storage means 14, that creates the table shown in FIG. 11 by associating the cylinder number, the crank angle and the common rail fuel pressure with one another and stores the table.

Figure 13:
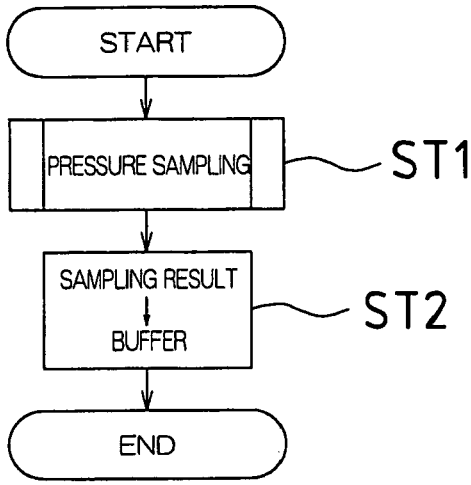
FIG. 13 is a flowchart describing the operation for detecting the common rail fuel pressure.

A flowchart of FIG. 13 illustrates this operation. That is, when the engine operation starts, the pressure sensor 13 detects the common rail fuel pressure each time the crank angle rotates 6° from the initial angle (Step ST1), whereas the storage means 14 store the pressure detection result (sampling results) in buffer by associating the result with the cylinder number and the crank angle (Step ST2). This operation is repeated each time the crank angle rotates 6°, thus creating the aforementioned table based on the stored data.

Figure 14:
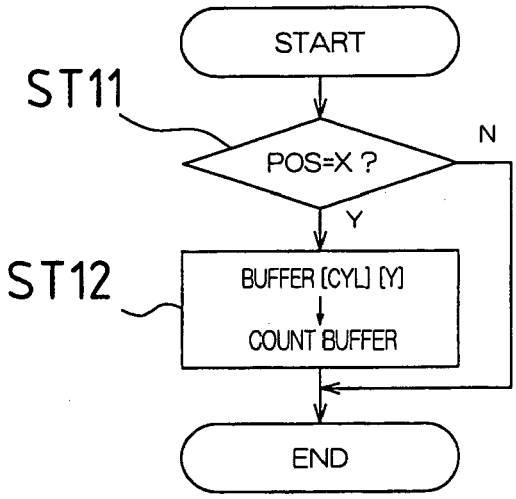
FIG. 14 is a flowchart showing count operation for controlling the common rail fuel pressure using a pressure detection data table.

FIG. 14 is a flowchart illustrating the count operation for deciding conditions for controlling the common rail fuel pressure using the above table. In this count operation, it is judged in Step ST11 whether the present crank angle POS is the correct timing for referencing the common rail fuel pressure during the detection operation of the common rail fuel pressure. When the determining is YES, the process proceeds to Step ST12. The timing for referencing the pressure is, for example, set at a timing preceding from the timing at which to execute the control conditions obtained from the count—the timing that takes into account the amount of time it takes for pressure data extraction and count.

In Step ST21, the aforementioned table is referenced, extracting the common rail fuel pressure corresponding to the cylinder number CYL and the given crank angle POS and sending the data to a count buffer. In the count buffer, count is performed, for example, to find conditions to obtain the optimal common rail fuel pressure.

As a specific example, we assume that the first cylinder is recognized. If, using (computing) pressure data detected at the tenth pulse timing (timing at POS=10), one attempts to execute the control conditions at the fifteenth pulse timing (timing at POS=15), then the result of determining is Yes in Step ST11 at the third pulse timing (timing at POS=3). Then, the pressure data at the tenth pulse timing (timing at POS=10), acquired previously when the first cylinder was recognized, is extracted and sent to the count buffer for count. It is to be noted that this count operation is merely an example and that the timings are not limited thereto.

As described above, it is possible according to the fuel pressure detector according to the present embodiment to acquire, with high accuracy, and store detection data on the common rail fuel pressure—data that constitutes basic data for obtaining the optimal fuel injection conditions (fuel injection time and amount) according to the engine rpm, engine load, etc.—through detection of the common rail fuel pressure every given crank angle and tabulation of the data. This makes it possible to readily recognize a variation pattern of the common rail fuel pressure according to the cylinder number and the crank angle as a result of the tabulation. As a result, a control program can be built with precision for properly controlling the common rail fuel pressure and the fuel injection time and amount associated therewith, thus allowing highly efficient control over engine operation.

In the present embodiment, the detection timing for the common rail fuel pressure is stipulated to be every given crank angle, ensuring excellent data reproducibility and thereby allowing acquisition of data preferred for controlling the common rail fuel pressure and the engine.

(First Modification)

A description will be given next of a modification of the aforementioned fuel pressure detector.

First, the first modification is intended to provide data discrimination means 15 for discriminating, from among data stored in the storage means 14, data related to the common rail fuel pressure in the step preceding the final pressure feed step (the second pressure feed step III), that is, during the time period from after fuel pressure feed in the first pressure feed step I until before fuel pressure feed in the next step (namely, the second pressure feed step III). In other words, the data discrimination means 15 can discriminate, in the present embodiment, data detected in the intermediate pressure step II—a non-pressure feed step between the first and second pressure feed steps I and III—and extract the data as necessary. More specifically, data may be discriminated as the data detected in the intermediate pressure step II by recognizing variations in the common rail fuel pressure. Alternatively, data may be discriminated as the data detected in the intermediate pressure step II by comparing the data with waveforms such as the crank angle signal (A), the cam angle signal (B) and the high-pressure pump 8 phase (C).

According to the configuration of the first modification, data discriminated and extracted by the data discrimination means 15 is that which is detected when the common rail fuel pressure is under the fuel injection pressure and when fuel is not pressure-fed into the common rail 2 (the intermediate pressure step II). That is, since the data is detected when the common rail fuel pressure is under the fuel injection pressure, it is the data detected at a timing falling outside those timings when the common rail fuel pressure is likely to change suddenly as a result of execution of fuel injection. Besides, since fuel is not being pressure-fed, this data is extracted as the data detected at a timing when variations in the common rail fuel pressure are relatively small. This allows extraction of common rail fuel pressure data detected with high accuracy.

While variations in the common rail fuel pressure are also relatively small in the injection pressure step IV, the pressure data detected at this timing may be the data in the process of or after fuel injection and therefore cannot be claimed to be desired data. This is the reason why the present modification extracts the pressure data at a timing falling outside those timings when the common rail fuel pressure is likely to change suddenly as a result of execution of fuel injection, thus allowing acquisition of highly reliable pressure data.

Particularly in the present example, fuel is pressure-fed to the common rail 2 in two steps, namely, the first and second pressure feed steps I and III, and data detected in the intermediate pressure step II, the non-pressure feed step between the first and second pressure feed steps I and III, is subject to discrimination and extraction by the data discrimination means 15. That is, this makes it possible to extract the pressure data that is detected immediately before the final pressure feed step when the common rail fuel pressure is relatively high (close to the fuel injection pressure). For this reason, in estimating the fuel injection pressure based on common rail fuel pressure data detected at a timing when variations are relatively small, it is possible to acquire common rail fuel pressure data detected at the most reliable timing (timing when the common rail fuel pressure is closest to the fuel injection pressure).

(Second Modification)

The aforementioned embodiment and the first modification are designed to detect the common rail fuel pressure every given crank angle. The present modification is instead designed to detect the common rail fuel pressure at each elapse of a given time.

Figures 15, 16:
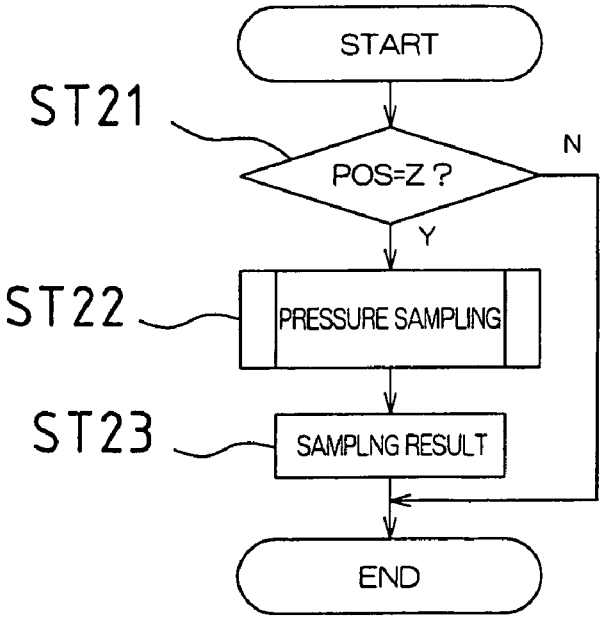
FIG. 15 illustrates a table stored in the storage means in a second modification.
FIG. 16 is a flowchart showing pressure detection operation in a third modification.

More specifically, the common rail fuel pressure is detected by the pressure sensor 13 every 5 msec during the engine operation, with the detection data sent to the storage means for creation of the table shown in FIG. 15. While the time intervals for pressure detection timing are not limited to 5 msec and may be set arbitrarily, it is preferred, to properly recognize the variation pattern of the common rail fuel pressure, that the time intervals be about several tens of psec to several msec.

It is to be noted that the table shown in FIG. 15 has been created by tabulating n-time sampling data, namely, common rail fuel pressure data detected over the time period of 5×n (msec).

The present modification also allows for acquisition with high accuracy and storage of detection data on the common rail fuel pressure—data that constitutes basic data for obtaining optimal fuel injection conditions (fuel injection time and amount) according to the engine rpm, engine load, etc.

If, in the above modification, the detection start timing for the common rail fuel pressure at each elapse of a given time is set to begin based on the crank angle, it is possible to acquire data based on temporal changes in the fuel pressure in the common rail 2 only over a necessary period of time. This ensures reduced detection load for the control device and provides improved compatibility between acquired and desired data.

In the present modification, the detection timing of the common rail fuel pressure is stipulated to be each elapse of a given time, thus allowing acquisition of data preferred for analyzing physical phenomena during the engine operation. For example, it is possible to obtain the common rail fuel pressure as the data appropriate for analyzing the status of occurrence of pulsation arising in the common rail.

(Third Modification)

In the aforementioned embodiment and the modifications, the detected common rail fuel pressure data is tabulated. In the present modification, the common rail fuel pressure detected every given crank angle (e.g., every 6°) is used, as is, as the data for controlling the common rail fuel pressure without tabulating the data.

In the present modification, the common rail fuel pressure is detected in the step preceding the final pressure feed step (the second pressure feed step III), namely, during the time period from after fuel pressure feed in the first pressure feed step I until before fuel pressure feed in the next step (namely, the second pressure feed step III), and the pressure detection data is used as the data for controlling the common rail fuel pressure.

FIG. 16 is a flowchart illustrating the pressure detection operation in the present modification. In this operation, a determining is made in Step ST21 as to whether the crank angle has reached a given crank angle, and when that crank angle is reached, the pressure sensor 13 detects the common rail fuel pressure in Step ST22 (execution of pressure sampling). Then, in Step ST23, the common rail fuel pressure is controlled (e.g., controlling the high-pressure pump 8) using the detected common rail fuel pressure data as the data for controlling the common rail fuel pressure.

According to the configuration of the present third modification, the common rail fuel pressure is detected when the common rail fuel pressure is under the fuel injection pressure and also when fuel is not being pressure-fed into the common rail 2 (the intermediate pressure step II). That is, the common rail fuel pressure is detected at a timing when pressure variations are relatively stable, thus providing improved detection accuracy for the common rail fuel pressure.

OTHER EMBODIMENTS

In the aforementioned embodiment and modifications, descriptions have been given of application of the present invention to the common rail fuel injection apparatus provided in the six-cylinder diesel engine's fuel supply system. The present invention is not limited thereto and applicable to various types of engines including four-cylinder diesel engine.

On the other hand, the pulse signal detection may be conducted at the pulse leading or trailing edges. Further, the pulse signal detection may be carried out at any position in the pulse.

It is to be noted that the present application is based on Japanese Patent Application No. 2002-285873, filed in Japan, whose contents are incorporated herein by reference. The documents cited in this specification are incorporated entirely and specifically herein by reference.

INDUSTRIAL APPLICABILITY

As described above, the fuel pressure detector according to the present invention for the common rail type fuel injection apparatus and the common rail type fuel injection apparatus equipped with the fuel pressure detector are designed, in collecting common rail fuel pressure data during the engine operation, to prescribe sampling timings for fuel pressure data by detecting the common rail fuel pressure every given crank angle or at each elapse of a given time, making them effective for ensuring improved detection data accuracy and providing improved use value of the detection data. It is therefore possible according to the present invention to readily recognize a variation pattern of the common rail fuel pressure according to a cylinder number and a crank angle and provide improved detection data accuracy for the common rail fuel pressure. This makes it possible to build with precision a control program for properly controlling the common rail fuel pressure and the fuel injection time and amount associated therewith, thus allowing highly efficient control over the engine operation.

The invention claimed is:

1. A fuel pressure detector for a common rail type fuel injection apparatus, the fuel pressure detector disposed in the common rail type fuel injection apparatus for detecting the common rail fuel pressure, the common rail type fuel injection apparatus being equipped with a fuel pump for pressure-feeding fuel in a plurality of steps and raising the common rail fuel pressure to a given fuel injection pressure at the end of the final pressure feed step, a common rail for storing fuel pressure-fed from the fuel pump, and fuel injection valves for injecting fuel supplied from the common rail, the fuel pressure detector comprising:

cylinder number judgment means for judging a cylinder number of the engine;

crank angle detection means for detecting a crank angle;

pressure detection means for detecting the common rail fuel pressure every given crank angle in response to an output signal from the crank angle detection means;

storage means for storing the cylinder number, the crank angle and the common rail fuel pressure by associating them with one another in response to outputs from the cylinder number judgment means, the crank angle detection means and the pressure detection means; and data discrimination means for discriminating, from among data stored in the storage means, data related to the common rail fuel pressure during the time period from after fuel pressure feed in the step prior to the final pressure feed step until before fuel pressure feed in the next step.

2. The fuel pressure detector for a common rail type fuel injection apparatus according to claim 1, wherein the data discrimination means are configured to discriminate data related to the common rail fuel pressure during the time period from after fuel pressure feed in the step one step preceding the final pressure feed step until before fuel pressure feed in the final pressure feed step.

3. A fuel pressure detector for a common rail type fuel injection apparatus, the fuel pressure detector disposed in the common rail type fuel injection apparatus for detecting the common rail fuel pressure, the common rail type fuel injection apparatus being equipped with a fuel pump for pressure-feeding fuel in a plurality of steps and raising the common rail fuel pressure to a given fuel injection pressure at the end of the final pressure feed step, a common rail for storing fuel pressure-fed from the fuel pump, and fuel injection valves for injecting fuel supplied from the common rail, the fuel pressure detector comprising:

crank angle detection means for detecting a crank angle; and pressure detection means for detecting, in response to an output signal from the crank angle detection means and every given crank angle, a common rail fuel pressure during the time period from after fuel pressure feed in the step prior to the final pressure feed step until before fuel pressure feed in the next step.

4. The fuel pressure detector for a common rail type fuel injection apparatus according to claim 3, wherein the pressure detection means are configured to detect the common rail fuel pressure every given crank angle during the time period from after fuel pressure feed in the step one step preceding the final pressure feed step until before fuel pressure feed in the final pressure feed step.

5. A common rail type fuel injection apparatus equipped with the fuel pressure detector according to any one of claims 1, 2, 3, and 4, wherein fuel supplied from the common rail is injected from fuel injection valves to a combustion chamber.

* * * * *